United States Patent [19]

Johnson et al.

[11] 3,995,144

[45] Nov. 30, 1976

[54] BANKED BOMBING SYSTEM

[75] Inventors: Frithiof V. Johnson, Binghamton; Gene Tye, Endwell, both of N.Y.

[73] Assignee: General Electric Company, Binghamton, N.Y.

[22] Filed: Sept. 14, 1966

[21] Appl. No.: 579,405

[52] U.S. Cl. ..... 235/61.5 E; 89/1.5 E; 235/150.2; 235/61.5 D

[51] Int. Cl.[2] ..... G06F 15/58

[58] Field of Search ..... 235/61.5, 150.26, 150.2, 235/61.5 D, 61.5 R, 61.5 E; 89/1.5 E

[56] References Cited

UNITED STATES PATENTS

| | | | |
|---|---|---|---|
| 2,985,365 | 5/1961 | Helgeson et al. | 235/61.5 |
| 3,133,188 | 5/1964 | Satyendra | 235/61.5 |
| 3,405,221 | 10/1968 | Nelson | 235/150.26 |
| 3,427,437 | 2/1967 | Tye | 235/61.5 R |

*Primary Examiner*—H.A. Birmiel
*Attorney, Agent, or Firm*—I. David Blumenfeld

[57] ABSTRACT

Method and sighting apparatus for aerial bombing from a curved approach path in a plane other than a vertical plane. Computer calculates and drives proper lead angle for sight which includes a reticle for target tracking with freedom to move in two dimensions. Computation, which is based on the relationship of lead angle and rate of turn of the aircraft in a curved flight path through the bomb release point, also considers airspeed, initial distance to target, bombing distance from target, aircraft mass, and can account for wind velocity, bomb characteristics and air density.

4 Claims, 10 Drawing Figures

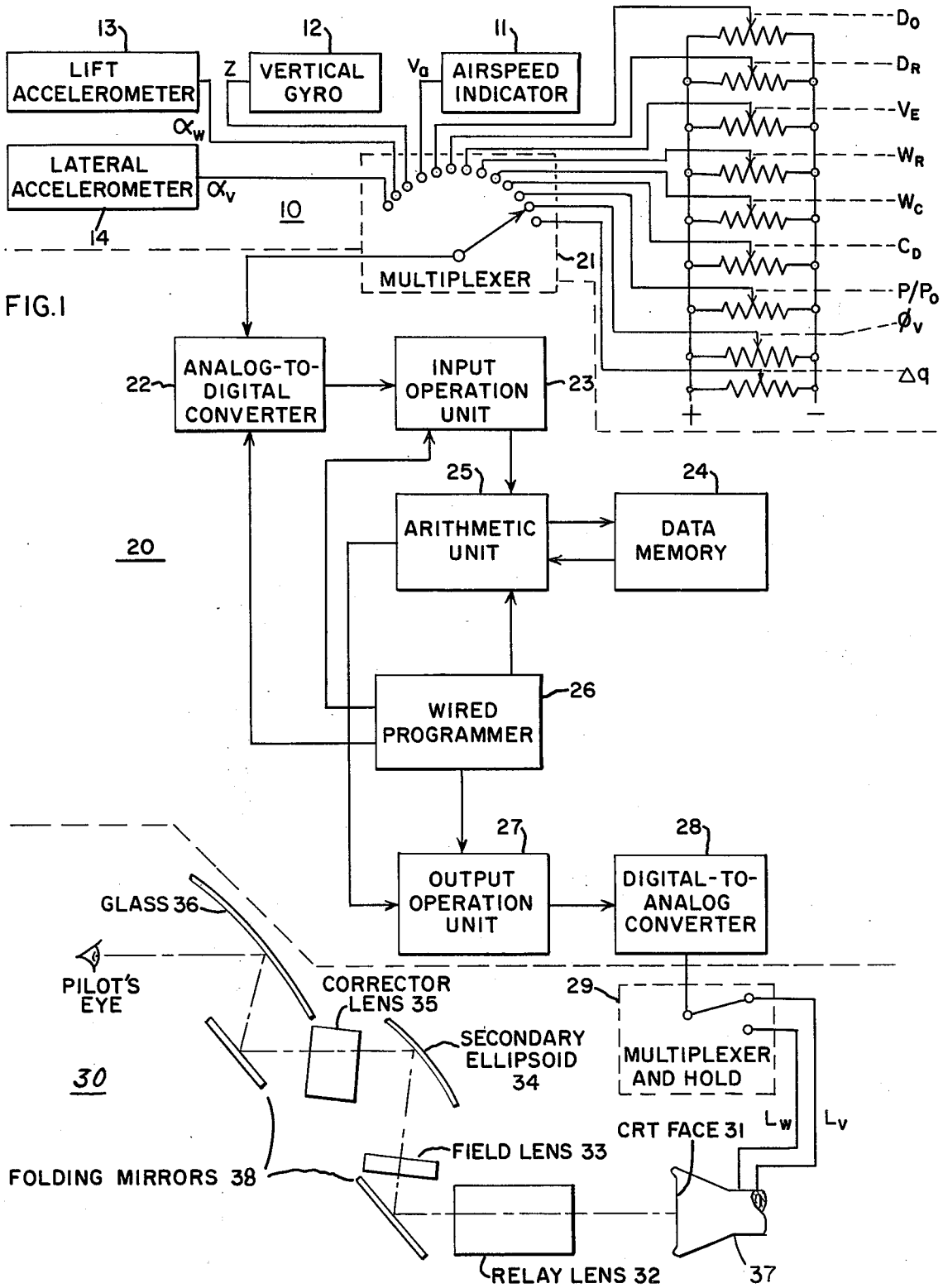
13
LIFT ACCELEROMETER
12
VERTICAL GYRO
11
AIRSPEED INDICATOR
Z
$V_a$
$\alpha_w$
LATERAL ACCELEROMETER
$\alpha_v$
14
10
MULTIPLEXER
21
$D_O$
$D_R$
$V_E$
$W_R$
$W_C$
$C_D$
$P/P_O$
$\phi_v$
$\Delta q$
+
−
FIG.1
22
ANALOG-TO-DIGITAL CONVERTER
INPUT OPERATION UNIT
23
25
ARITHMETIC UNIT
24
DATA MEMORY
20
WIRED PROGRAMMER
26
27
OUTPUT OPERATION UNIT
28
DIGITAL-TO-ANALOG CONVERTER
GLASS 36
PILOT'S EYE
CORRECTOR LENS 35
29
SECONDARY ELLIPSOID 34
MULTIPLEXER AND HOLD
30
$L_w$
$L_v$
CRT FACE 31
FIELD LENS 33
FOLDING MIRRORS 38
RELAY LENS 32
37

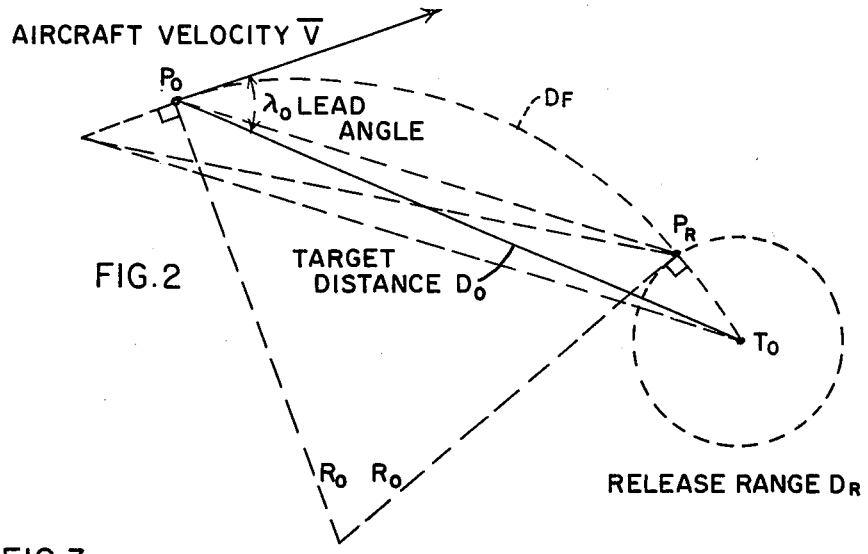
FIG.2
FIG.3
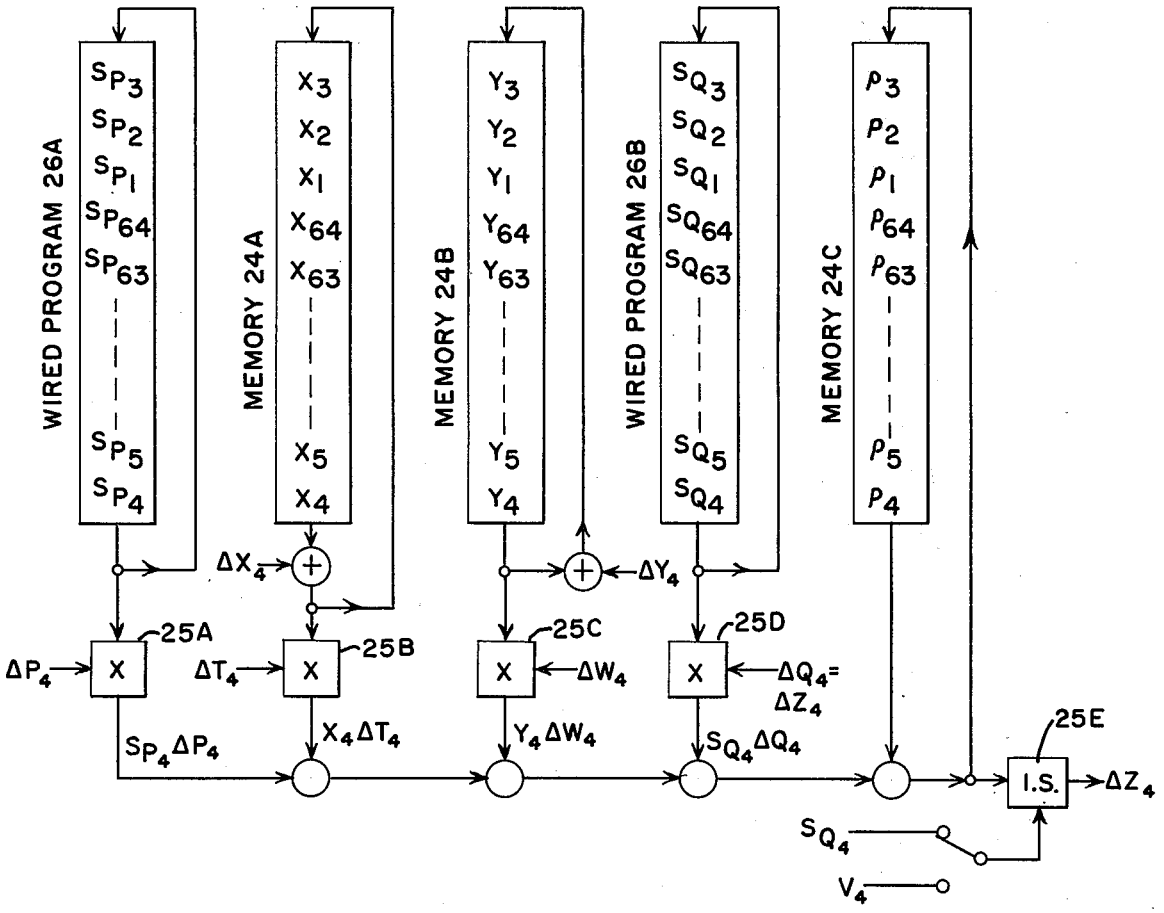

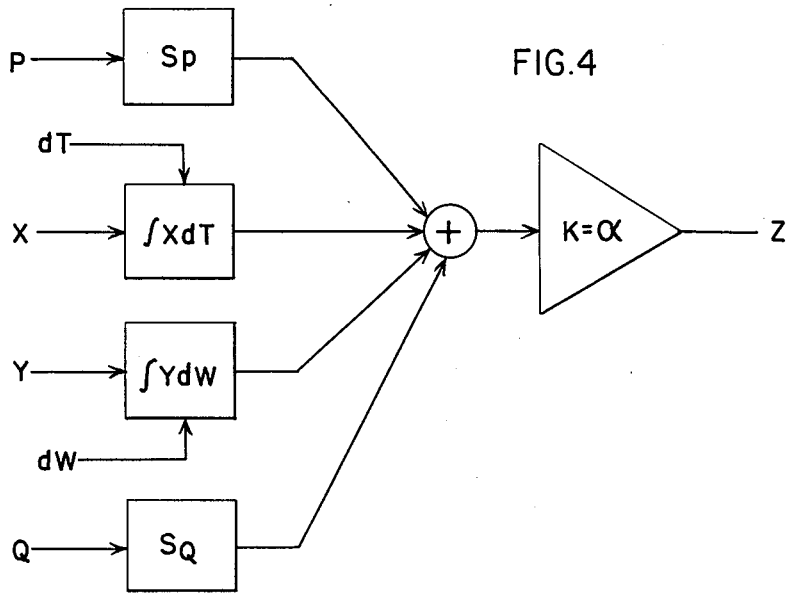
FIG.4
FIG.5A
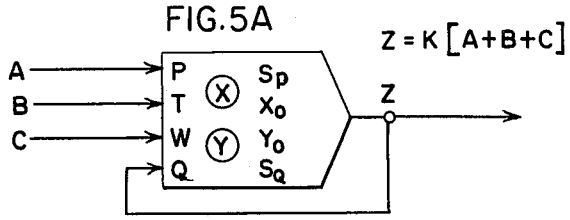
FIG.5B
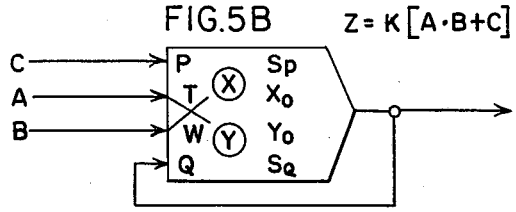
FIG.5C
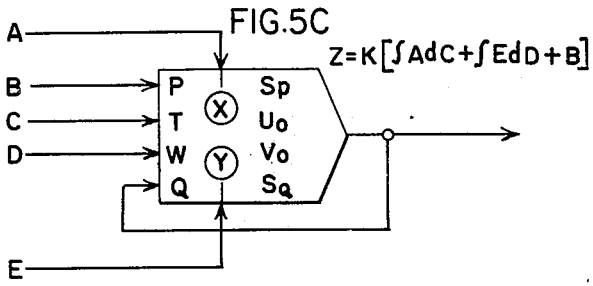
FIG.5D
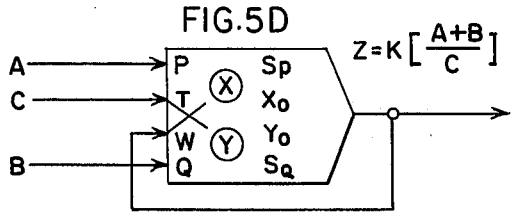
FIG.5E
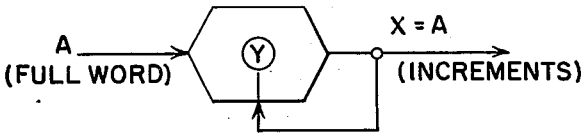
FIG.5F
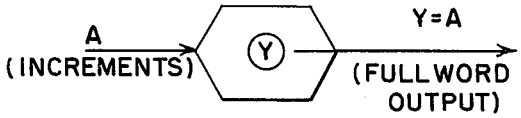
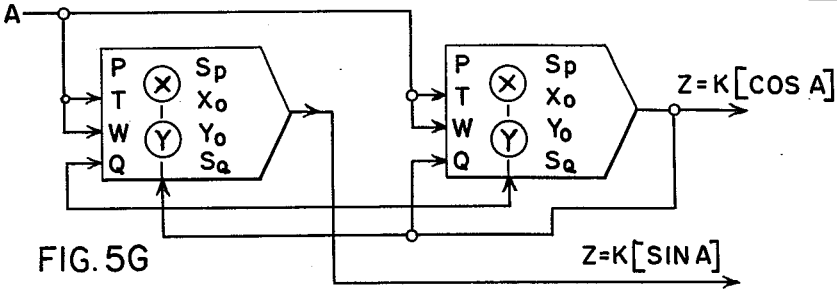
FIG. 5G

BANKED BOMBING SYSTEM

This invention relates to a control system for an aircraft that enables manual or automatic target tracking to a proper release point for bombs or other airborne stores. The salient feature of the invention is the use of curved flight paths in planes which are slanted with respect to the normal orthogonal reference axes, particularly the vertical axis, through the target. The computer required is compatible with various vehicle instrumentation systems, with different types of attack, and is particularly well adapted for compensating for initial target range error.

Up to the present time, bomb delivery techniques have been based on release from a wings-level flight (i.e., no roll), or from an attitude departing from wings-level only enough to compensate for cross-wind effects. Wings-level flight restraining an aircraft to movement within a vertical plane containing the target reduced bombing variables by maintaining a constant ground azimuth of flight and of bomb trajectory but caused other limitations. Some of the problems introduced by this requirement are obvious. Among these are:

After identifying the target, a long time is required before aircraft heading and attitude can be brought to values required to start a bomb release run and to begin to acquire tracking data.

The small lead angle visible over the aircraft nose makes it impossible to keep the target in view to the release point when delivering high-drag stores, or when delivering relatively clean stores from low-level flight or long range.

There is serious vulnerability to defense weapons for an aircraft making such a wings-level run in a vertical plane directly over the target defenses, because future aircraft positions are easily predicted even though the flight path may have a curvature within the vertical plane.

Less obvious, though of first importance, is the difficulty of achieving high accuracy in such a wings-level maneuver. It might be assumed that control in the vertical plane is most critical, because it involves computing a lead angle depending on the range, speed, and bomb drag characteristics. In contrast, control in the lateral direction with a reticle tracking accuracy of 2 to 5 milliradians appears to be reasonable and consistent with experience in both bombing and air-to-ground gunnery. At a typical bomb release range of 1500 feet, this accuracy should correspond to a lateral impact error of 3 to 8 feet. Actually, lateral impact errors are commonly on the order of 10 times this large.

Accurate lateral control of both reticle and velocity vector in a wings-level maneuver is extremely difficult. That is, precise control of the direction of aircraft motion relative to the ground, as opposed to apparent direction on the basis of instantaneous heading, is generally complex, particularly when complex maneuvers are involved. For example, to move the reticle to the right requires first a roll to the right. In most aircraft the immediate response is a yaw to the left. In a conventional bombing mode with a depressed reticle, the roll produces a large additional motion of the reticle to the left. When the pilot judges that a sufficient correction has been made through the rate of turn, he reverses the procedure, and the same perturbations require a large degree of prediction. It is probable that the problem is so difficult to handle in the limited time available that the pilot makes his final corrections, sometimes of several degrees, by sideslipping into an aircraft attitude which seems to give a correct tracking condition; in spite of the fact that this does not control the aircraft velocity vector which determines the bomb path.

One result is that, if the target is sighted off the line of flight, the time required to correct heading, establish wings-level attitude, and carry out the bomb run is on the order of 3 times that needed for the most direct maneuver into a bomb release condition. Even this time does not permit refining the lateral error to a value effective for attacks on hard-point targets.

In fire control problems generally, the system is arranged to produce a correct lead angle when the target is being tracked properly under steady-state conditions. Before the start of tracking, or when tracking adjustments are made, it is necessary to change the aircraft position and/or rate of motion. These changes are additions to steady-state tracking motions and cause undesired signals to be generated by tracking instruments responsive to the incremental corrections. This normally results in spurious settling transients which must die out before steady-state tracking exists.

It should be noted that the availability of accurate range data, as from a LASER instrument, does not of itself solve any of these lateral control problems. Although range information is required for effective bomb delivery, its explicit measurement is not a dominant, or even first-order factor, in the delivery of moderate-drag weapons.

Accordingly, an object of the invention is to provide a system implemented in sufficiently basic terms so that it requires that the direction of the aircraft velocity be correct only at release, and does not otherwise limit the attitude or the maneuver through which the release condition with proper velocity vector is reached.

Another object of the invention is to provide a bombing system having a configuration sufficiently flexible to handle all types of attacks, whether low-level, dive, straight, or banked, without change in mode, method of computation, or tracking dynamics.

A further object of the invention is to provide a bombing computer having the ability to acquire range information without radiating sensors.

Another object of the invention is to provide a bombing system having improved tracking dynamics, so that control of the reticle produces accurate control of the velocity vector.

An additional object of the invention is to provide a bombing system having the ability to use the large lead angles visible in banked maneuvers for delivery of high-drag stores.

Briefly stated, it has been discovered that a bombing system can be provided, with ordinary levels of complexity, which directs an aircraft from a very wide range of initial target sighting positions to a proper release point without constraining the aircraft to a straight line approach path or to any one path. The preferred mode of implementation uses a controlled sight reticle that when continuously aligned with the target results in a curved path which leads to a release point at a preselected release range with the aircraft velocity vector aligned with the target. That is, for a given present aircraft position, a particular maneuver is directed which starts with the present aircraft velocity and position. Whenever he chooses, the pilot initiates the proper smooth centripetal acceleration by controlling the aircraft so as to maintain zero tracking error, and no initial position or velocity change of an incremental nature is required. Also, the system is particularly well adapted to incorporate automatic compensation for target range error on the basis of tracking dynamics.

An important aspect of the invention is that it enables automatic sight reticle placement (providing an aiming point), without requiring the pilot to observe any dials or to adjust the bombing computer for a particular observed tactical situation beyond the initial target range setting. The pilot has a large range of choices for his approach to a target, with negligible restrictions. If he does not elect to initiate tracking immediately, he can fly in any manner to almost any point in the general direction of the target. When he wants to, the pilot starts tracking by pushing a tracking button and the reticle then indicates the proper lead angle for maintaining the circular path (or the equivalent) for that position and aircraft velocity. In the preferred embodiment, the pilot needs only to fly the aircraft so as to maintain alignment of the reticle with the target - the circular path is a result of maintaining the computer directed alignment condition.

The invention, together with further objects and advantages thereof, may best be understood by referring to the following description taken in conjunction with the appended drawings in which like numerals indicate like parts and in which:

FIG. 1 is a block diagram of a one apparatus embodying the invention.

FIG. 2 is a diagram illustrating a curved bombing run.

FIGS. 3, 4 and 5A–5G are block diagrams descriptive of the sight computer of FIG. 1.

Figure 6:
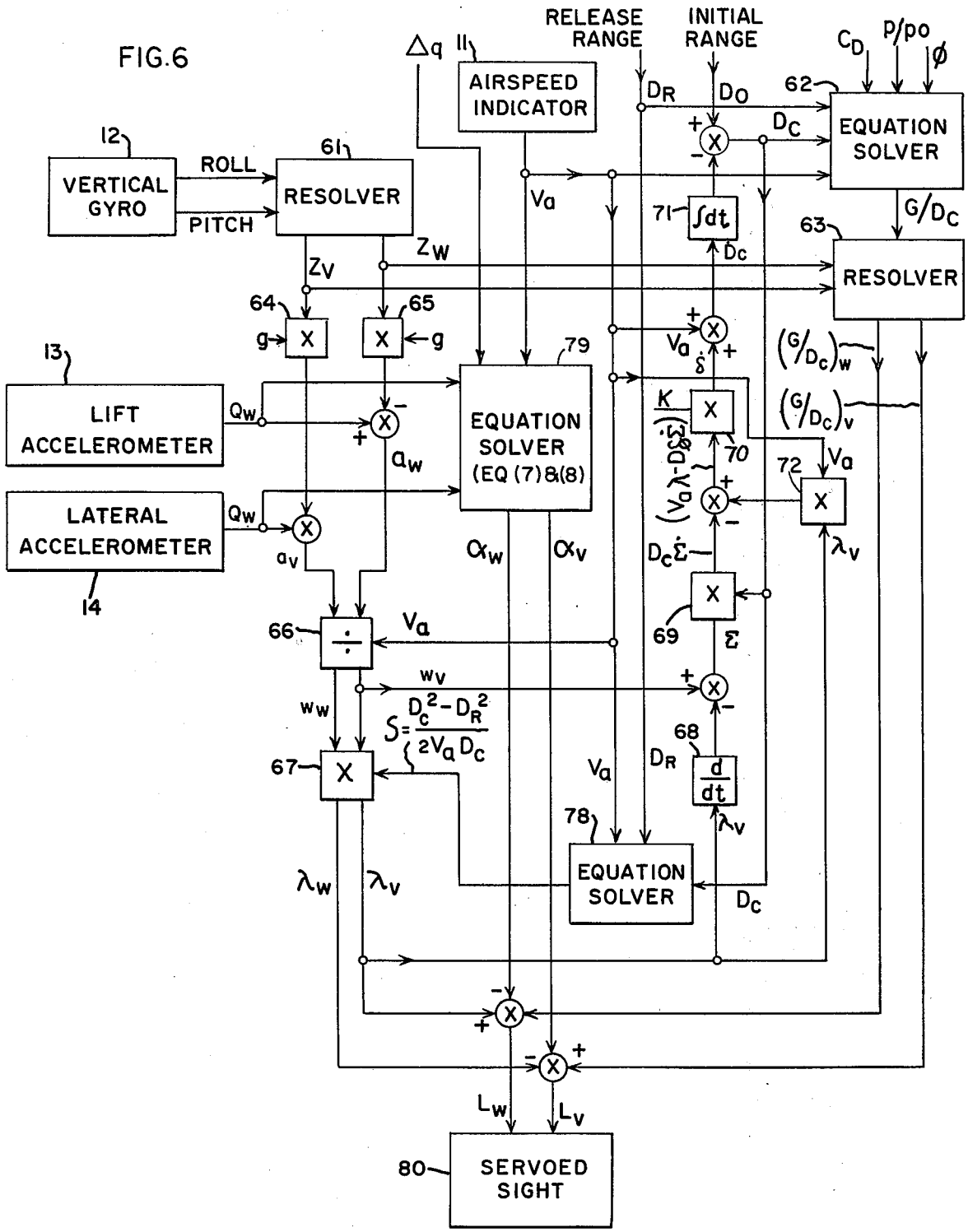
FIG. 6 is a block diagram of an alternative embodiment of the invention.

More specifically, FIG. 1 for purposes of illustration contains various functional subcomponents in a block diagram and includes as principal components a wide angle sight 30, computer apparatus 20 for driving an illuminated reticle in the sight to display a lead angle according to predetermined relationships among parameters and variables and a sensor bank or input signal generator system 10 for providing input signals representative of variables and parameters from which a proper bomb run can be computed. The wide angle sight 30 illustrated is of the heads-up type wherein an illuminated aiming reticle or spot is generated in a cathode ray tube 37 and projected from face 31 thereof through optical components to a combining glass 36 where it is used by the pilot to align the aircraft. Proper alignment is obtained by deflection of the illuminated reticle by changing the drive signals supplied to the cathode ray tube 37. Lenses and mirrors 32, 33, 34, 35 and 38 illustrated are representative of the typical components of a heads-up display system, not critical parts of this invention, and are shown so as to illustrate a complete and workable system. The sensor bank or input signal generator system 10 as illustrated contains sensors 11, 12, 13, 14 for generating electrical signals representative of certain variable quantities in the environment and also contains a bank of potentiometers representing the sources of signals conveying other variable quantities or parameters. The potentiometers are identified by the symbols of the input quantities defined below. Computer 20 is illustrated in the terms of a block diagram of functional digital subcomponents and receives its input at analog to digital converter 22 from the sensor bank 10 through multiplexer 21 which is an electronic sequencing switch to permit sending a plurality of signals through one channel to permit use of a single analog to digital converter 22. The input unit 23 divides the multiplexed digital signals received from converter 22 into proper specific increments so that the computation functions can be performed using the incremental signals in arithmetic unit 25. Data memory 24 cooperates with the arithmetic unit 25 as more specifically illustrated in FIG. 3 and described hereinafter.

As shown in FIG. 1 and described above is general terms, in practicing the invention for non-automatic bombing the primary requirements are: a wide-angle sight 30 for presenting an aiming reticle with a large lead angle capability; a conventional set of instruments and adjustable input devices 11, 12, 13 and 14 for providing a source of signals representing airspeed, turning rates or acceleration, and attitude; input signal sources for target range, release range, and bomb characteristics; and computer apparatus for processing the data and operating the sight (20). Although many kinds of conventional computer apparatus can be employed, a digital incremental computer of the type described in U.S. Pat. No. 3,109,090, "Variable Increment Computer" issued Oct. 29, 1963, to E. H. Cabaniss and J. S. Prince, is a practicable implementation of the invention. The symbols used in the drawings and in the specification hereinafter are defined as follows:

$\mu$ = total lead angle in system of axes $p, j, r$
$L_v$ = elevation component of lead angle in system of axes $u, v, w$
$L_w$ = traverse component of lead angle in system of axes $u, v, w$
S = scale factor
$s_1$ = kinematic lead sensitivity factor
$S_2$ = gravity drop correction factor
$S_3$ = cross-wind correction factor
$S_4$ = vertical bomb ejection velocity correction factor
$u$ = orthogonal airframe axis forward
$v$ = orthogonal airframe axis along right wing
$w$ = orthogonal airframe axis downwards
$P$ = orthogonal computing axis along velocity vector $\overline{V}$
$q$ = orthogonal computing axis in the UV plane
$r$ = orthogonal computing axis in the UW plane
$z$ = unit vector along the vertical terrestial axis through the aircraft
D = target distance
$D_R$ = bomb release range
$D_o$ = initial range estimate
$D_c$ = corrected or precision target range
$\dot{D}$ = range rate
$D_a$ = air mass range
$D_F$ = distance along the flight path
$D_e$ = equivalent vacuum range
$g$ = gravity acceleration constant
$V_e$ = bomb ejection velocity
$\alpha$ = angle of attack
$\gamma$ = smoothed turn rate
$T_s$ = smoothing time
$\overline{V}$ = velocity vector
$V_a = |\overline{V}|$ = airspeed
$W_R$ = range component of wind velocity (in the vertical plane through the line-of-sight)
$W_c$ = horizontal component of wind velocity normal to the line-of-sight
$\delta$ = kinematic correction factor
$C_D$ = drag/mass parameter
$\rho/\rho_o$ = relative air density
$\omega$ = turning rate $P_o$ = aircraft position at first target sighting
$a$ = aircraft acceleration
Q = $a-g$ = accelerometer output signals, which include gravitational forces
$T_2$ = time delay for bomb release
N = smoothing term
$\dot{\Sigma}$ = turning rate of line-of-sight = $\omega - \dot{\lambda}$
M = aircraft mass
$C_V$ = lift coefficient
$\phi_v$ = attitude of aircraft armament datum line for zero lift
$\Delta_q$ = differential pressure (pitot minus static)
$T_o$ = target reference position
$R_o$ = initial radius of path curvature
P = aircraft pitch angle
R = aircraft roll angle
$P_R$ = bomb release position
X, Y are whole word variables
$S_p$, $S_Q$ are whole word fixed constants
T, W, P, Q are increments or changes in data
S is a scale factor
Z is the output increment
$R_i$ is the remainder
$\rho_i$ is the value of the summation
(subscripts $p$, $q$, $r$, $u$, $v$, $w$, $z$ represent components along the respective axes $p$, $q$, $r$, $u$, $v$, $w$, $z$)

FIG. 2, the figure illustrating the bombing run curvature, is a planar illustration taken through the line of flight as determined by the target and the original plane position and has no reference to the vertical. This is because the plane of the flight path illustrated can be tipped according to this invention to a substantial angle from the vertical. FIG. 2 shows flight path $D_F$ from the aircraft position $P_o$ at target sighting to target $T_o$ and illustrates how a constant lead angle $\lambda_o$ between the line of sight $D_o$ and the velocity vector V could cause a flight path of constant curvature. FIG. 2 shows the bomb release range $D_R$ as a circle conveying the concept that the bomb release point is determined by intercept of the flight path with the bomb release range.

As can be seen by the geometrical construction in FIG. 2, an aircraft at $P_o$ with inertial (or ground) velocity $\overline{V}$ at an initial angle $\lambda_o$ to the line-of-sight to target reference position $T_o$, is constrained by a given release range $D_R$ and an initial target distance $D_o$ to a unique path of constant curvature, to which the velocity vector is tangent at both the initial sighting $P_o$ and the point of release $P_R$. That is $\lambda_o$, $D_o$, $D_R$, and the tangent requirements determine a circle. Since the plane of illustration in FIG. 2 is the plane of flight, $T_o$, the target reference point is a point in space directly above the target a distance related to the gravity drop of the bomb in travel through the bomb release range.

The aircraft has the proper position and velocity from the start, and requires no correction movements which in general disturb the sensing instruments. However, target distance $D_o$ is not generally available with accuracy; and the angle $\lambda$ between the velocity vector and the line-of-sight is not available without some means to measure the angle between the aircraft heading and the line-of-sight. Furthermore, it is necessary to solve target tracking problems in terms of the airborne system, as opposed to the ground surface oriented problem shown. Also, various factors such as the gravity drop, wind correction, etc., must be treated as in conventional systems. Although FIG. 2 does not indicate a gravity drop factor, which is basically a fixed offset factor to be considered hereinafter, it is generalized for any plane containing the initial aircraft velocity vector V and the effective target position. The only limitations are $\lambda < 90°$, $D_o/D_R > 1$, and the practical turning rate limits on the aircraft.

It has been found that the constant curvature path problem can be treated in the airborne system on the basis of aircraft turning rates and apparent traverse and elevation lead angles $\lambda_v$ and $\lambda_w$. That is, it is practical with this choice of variables to mechanize a constant inertial curvature problem and to use aircraft variables by workable corrections. In terms of the ratio of aircraft turning rate $\omega$ to aircraft speed, the relationship is as follows:

$$\omega/V_a = +2(D\cos\lambda \sin\lambda)/(D_o^2 - D_R^2)$$

or $$\omega = -2(DD \sin\lambda)/(D^2 - D_R^2) \quad (1)$$

Most important, it has been found that the bombing approach problem can be solved by constraining an aircraft to perform merely a calculated turning maneuver (during tracking) in which the pilot continuously aims the aircraft as calculated. The turning maneuver performs the dual functions of both a measurement of lead angle and generating a correct tracking path. The FIG. 1 system combines with calculation with path measurement, and the pilot combines an aircraft turning maneuver with target sighting by the essentially unitary task of maintaining alignment of the sight reticle and the target. Correct tracking for bombing is achieved by maintaining an equilibrium condition in which the response of the sight (reticle) properly balances the aircraft inertial motion or ground track. Accordingly, computer 20 enables the solution of equation (1) by appropriate sub-equations.

It should be noted that the invention is not limited to a path of constant curvature. Other curved paths constant can be employed. However, it is essential that the path provide tangents for the aircraft velocity vector at the initial target sighting point $P_o$ and for the line-of-sight at the release point $P_R$. This permits the aircraft pilot to fly the desired approach path by introducing the proper turning rate, without requiring an incremental change in position or velocity. An infinite family of appropriate paths are provided to accommodate the infinite possible initial conditions. If the pilot does not use the correct centripetal acceleration by maintaining reticle alignment, he departs from the original desired path. However, this merely results in a new initial position problem which is solved by the computer.

The computer 20 of FIG. 1, in order to solve the various equations, uses the algorithm diagrammed in FIG. 3 which can be expressed algebraically as follows:

$$\pm X\Delta T \pm Y\Delta W \Delta S_p \Delta P \pm S_Q \Delta Q \pm \rho_{i-1} = \rho_i = R_i + S\Delta Z \quad (2)$$

The multiplexer 21 is used to sequence the analog inputs through a single analog-to-digital converter 22. These inputs are selected under program control to occur at any of 64 algorithm times. The computer performs all computations using incremental techniques. An input operation 23 converts the whole word digital input data into the desired increments. These increments are processed in the arithmetic unit 25 to provide the desired computations. The arithmetic unit is controlled sequentially by the program stored in a wired core programmer 26. More specifically, the content and operation of computer 20 can be described by reference to the functional diagram of FIG. 1 wherein multiplexer 21 as a result of successive sampling transmits analog information derived from the several sensing devices to A/D converter 22 in a predetermined sequence. A/D converter 22 converts the analog information to digital form in a conventional manner using timing and control signals from wired programmer 26. The information is next passed to input operation 23 as serial (or time sequential) digital data in whole word serial form. Input operation 23, which normally and for practical efficiencies would share electronic equipment with the output operation unit 27, converts the whole word samples into increments (changes of values) which subsequently represent the input variables in computations. The incremental change information passes to arithmetic unit 25 where computation of the bombing problem takes place through mechanization of equation (2) with assistance of data memory 24 through storage of intermediate results and as controlled by wired programmer 26. Information in the form of increments representing output variables as computed by arithmetic unit 25 are transmitted to output operation 27 which sums up the increments, returning the information to whole word form for conversion to analog form by D/A converter 2.

In the output operation the output increments are accumulated to produce the whole word output data which are sequenced through a single digital-to-analog converter 28. The multiplex and hold circiutry 29 routes the resulting sequential analog signals to the proper output line. As noted previously, efficient mechanization could include the combination of the input and output operation units 23 and 27 into one structure.

FIGS. 4 and 5 illustrate other functions performed in the computer 20 of FIG. 1.

The computer has six input variables: P, Q, X, Y, dT and dW. The P and Q inputs are multiplied by scale factors $S_p$ and $S_Q$. The other four inputs are used to perform two independent integration operations. All of these four paths are summed and fed to the increment selector 25E (FIG. 3) which has the equivalent gain of ∞. This then is the basic algorithm building block which is modified by feedback to give the desired function. For example, if the output, $Z_i$, is fed back to the Q terminal, the feedback loop provides a transfer of $$\frac{1}{S_Q}.$$

Thus, an input at P yields an overall transfer of $$\frac{S_p}{S_Q}.$$

Inputs for the other two paths will yield:

$$\frac{1}{S_Q}\left(\int X\,dT + \int Y\,dW\right).$$

The total output is:

$$Z = \frac{P\,S_p + X\,dT + Y\,dW}{S_Q} \qquad (3)$$

(If certain inputs are eliminated, the corresponding terms in the equation drop out.) This complex equation can be solved in only one algorithm. Other feedback combinations are used to produce a whole list of transfer functions.

In order to simplify the generation of system flow diagrams, a symbol has been developed for this algorithm. It is shown in FIG. 4. The six inputs P, Q, X, Y, T, and W correspond directly to those of the diagram previously discussed. It is the function of the wired core programmer 26 to obtain these inputs from the proper place in memory 24 to effect the proper inputs and feedback paths.

The computer uses a variable increment arithmetic unit 25. It achieves the high iteration rate capabilities of the well-known DDA but avoids the following shortcomings: (1) rate limiting during slew conditions does not result in loss of information, (2) it has a sophisticated set of standard operations, eliminating drift resulting from second-order approximations; (3) it has completely flexible scaling so that it avoids resolution traps encountered in the "over flow" type DDA, (4) it has a zero magnitude increment to avoid so called "rectification error" drift.

The arithmetic unit in FIG. 3 mechanizes the operations indicated. The FIG. 3 diagram which integrates functions of arithmetic unit 25, memory 24 and wired programmer 26 depicts the relative positions of the internal data corresponding to the time of the fourth algorithm. (Each algorithm is processed in sequence and the complete iteration is begun again.) The inputs (ΔP,ΔY, etc.) are all incremental and are obtained from memory 24 under control of the programmer 26. The constant scale factor stored as part of the problem program for algorithm No. 4, is here designated $S_{P_4}$. It is fed to an increment multiplier 25A where it is multiplied by $\Delta P_4$. Since all increments (ΔP,ΔY, etc.) are restricted to integral powers of two ($0 \pm 2^0, \pm 2^1, \pm 2^2, \ldots \pm 2^6$) the multiplication can be performed by merely shifting the binary point the appropriate number of places. Since the computer is a serial machine (i.e., bits are time sequential, least significant bit first), this shifting of the binary point can be effected by merely introducing the proper number of bits delay to the serial string of binary data representing the scale factor $S_{P_4}$. The result is the product $S_{P_4}\,\Delta P_4$ (the incremental form of $S_pP$ which we recognize as one term of the algorithm).

The second register 24A depicted is that of the X accumulation. The $\Delta X_4$ input increment is used to update the old value of $X_4$ and the result is stored at the end of the X shift register. This term is also fed to an increment multiplier 25B which has a $\Delta T_4$ multiplier factor. The result is $X_4\Delta T_4$, which can be recognized as the incremental form of $\Sigma X_4\Delta T_4$, which is approximately equal to $\int X_4 dT_4$. This was the second term of the standard algorithm previously discussed.

In a similar manner the incremental forms for $\int Y_4 dW_4$ and $S_{Q_4}\Delta Q_4$ are generated. All of these terms are summed together with any effective residue remaining in the $\rho$ register for this fourth algorithm. This is designated $\rho_4$.

In normal operation the contents of the $\rho$ register are very nearly zero. The $\rho$ register essentially functions as a surge tank. The value of increment generated for the output $\Delta Z_4$ is determined by the increment selection unit 25E. Since ΔZ might be used as the input for other algorthims it must be an integral power of two as previously discussed. Thus, there is a difference between the increment actually selected and the quantity fed into the increment selector. To ignore this difference would lead to large drift errors. The use of the $\rho$ "surge tank" and the feedback technique used in applying the algorithm eliminate this problem. In actual use the old output $\Delta Z_4$ is fed back negatively to the $\Delta Q_4$ input. It is scaled as desired by $S_Q$ and is thus in effect subtracted from the old desired quantity $\rho_4$. This net residue along with the sum of the changes due to the other inputs ($\Delta P_4, \Delta X_4, \Delta T_4$, and $\Delta W_4$) is what the increment selector approximates to generate the new $\Delta Z_4$ output. It will be noticed that either $S_{Q_4}$ or $Y_4$ are fed to the increment selector. These quantities are required to introduce the effects of feedback scaling on the increment selecting process. $S_{Q_4}$ is used for multiplication, integration, summation, etc., while $Y_4$ is used for division, square root and such functions.

The increment selector is the heart of the variable increment technique. If the algorithm input quantities are changing rapidly, the increment selector is presented with a large change to approximate. It can choose increments from 0 to 64 depending on the speed required.

The diagrams in FIG. 5A–G show symbolically the algorithm connections for the functions required. The required functions are converted to the special functions which are then used to determine the proper threading of the control wires through the magnetic cores of the programmer 26.

For use in further computations, airframe attitude signals for pitch P and roll R from vertical gyro 12 are converted into direction cosines of a unit vector z parallel to the local terrestial vertical and the airframe reference axes uvw:

4. $u_z = \text{Sin P}$
5. $v_z = -\text{Cos P sin R}$
6. $w_z = -\text{Cos P Cos R}$ By straightforward coordinate transformations, the computer processes the input signals into a suitable form for computation in inertial coordinates. The signals from accelerometers 13 and 14 for lateral acceleration $Q_v$ and lift acceleration $Q_w$ provide, in a conventional manner, the angle-of-attack components of the airframe relative to the aircraft velocity vector, on the basis of the standard aircraft characteristics:

$$\alpha_v = \frac{Q_w MC_w}{\Delta q} \phi_v \tag{7}$$

$$\alpha_w = \frac{Q_v MC_w}{\Delta q} \tag{8}$$

(These equations in the FIG. 6 mechanization are solved by equation solver 79.)

From the components of centrifugal acceleration the turning rates of the aircraft velocity vector (and the computing axes) are determined:

$$\omega_r = \frac{1}{V}(gz_v - Q_v) \tag{9}$$

$$\omega_q = \frac{1}{V}(-gz_w + Q_w) \tag{10}$$

Also, for the computing inertial axes pqr, direction cosines for the latter two inertial axes relative to the unit vertical vector are derived.

$$z_r = -\alpha_v u_z + w_z \tag{11}$$

$$z_q = +\alpha_w u_z + v_z \tag{12}$$

It is also desirable to smooth the rate-of-turn signals in elevation $\gamma_q$ and traverse $\gamma_r$ with a time constant T on the order of one second:

$$\gamma_q + T_q\dot{\gamma} = \omega_q + T\omega_u\omega_r \tag{13}$$

$$\gamma_r + T_r\dot{\gamma} = \omega_r - T\omega_u\omega_q \tag{14}$$

In order to allow for wind and bomb drag effects on the target range data, the air mass release range $D_a$ is determined on the basis of the ratio of the range wind component $W_R$ and airspeed V in the form of the differential equation:

$$D_a = d_R + (W_R/V)(\quad D_a/\quad (W_R/V)) \tag{15}$$

The equivalent vacuum release range, on the basis of air mass release range $D_a$, the bomb drag coefficient $C_D$, and relative air density $\rho/\rho_o$ is:

$$D_e = {}_{Da}[+C_D(\rho/\rho_o)D_a] \tag{16}$$

These quantities are combined to form tracking and ballistic scale factors. On the basis of equation (11), and correct target range $D_c$, considered later, and range rate $\dot{D}$, the tracking factor S, is:

$$S_1 = (D_c^2 - D_R^2) / (-2\dot{D}D_c) \tag{17}$$

The gravity drop correction factor $S_2$ is:

$$S_2 = gD_eD_a / 2V^2D_c \tag{18}$$

The cross-wind displacement correction factor $S_3$ is:

$$S_3 = D_c + {}_{CD}(\rho/\rho_o)\dot{D}D_c\, W_C \tag{19}$$

For the bomb vertical ejection velocity $V_e$, the correction factor is:

$$S_4 = -D_eV_e/VD_c \tag{20}$$

For convenience, the computation is performed in two basically independent parts. Separate paths are computed for elevation and traverse and then combined in the sight. However, the computer is programmed as if the equations were independent problems. The computer outputs, in the inertial frame pqr before resolution into sight coordinates, are the instantaneous horizontal and vertical lead angles:

$$L_v = S_1\gamma_q + S_2z_r + S_3z_q - S_4 - \alpha r \tag{21}$$

$$L_w = S_1\gamma_r - S_2z_q + S_3q_r - \alpha_w \tag{22}$$

The above equations are on the basis of accurate target range $D_c$ data. Where the range is estimated and manually inserted or otherwise subject to substantial error, important improvements in system accuracy can be achieved by correcting range on the basis of actual tracking performance. The above computations generate lead angles which result in the pilot following a path that maintains the line-of-sight properly. If the initial range estimate was short, the aircraft tends to turn too fast. The rate of change of the lead angle is a direct function of the closing rate, $\dot{D} = V_a \cos\lambda \approx V_a$, and the computed path curvature. From one point of view, FIG. 2 indicates that the computed path curvature is a direct function of the estimated range and that the aircraft will not follow a proper path if there is range error. The movement of the line-of-sight at the aircraft is known to be:

$$V_a \sin \lambda \approx -\dot{D}\lambda \quad (23)$$

With proper range data, this same line-of-sight movement should be given by:

$$D_C(\omega+\dot{\lambda}) \quad (24)$$

Inequality of these expressions is therefore a function of the range estimate error, and from their difference a function exists for generating a range error correction:

$$\dot{\delta} = M[-\dot{D}\lambda - D_c(\omega+\dot{\lambda})] \quad (25)$$

This provides kinematic ranging which is most effective when rate of change of the tracking angle used is great. Because the rate of change of the traverse component of the lead angle becomes small as the release point is approached, the gravity drop offset is useful and therefore the entire lead angle $\lambda$ is used. The range correction is implemented by integrating target range:

$$D_c = D_0 - \int (V+W_R)dt + \int \dot{\delta}dt \quad (26)$$

In terms of the available signals, $\dot{\delta}$ is implemented as follows:

$$\dot{\delta} = -N\{\lambda_q[\dot{D}\lambda_q + D_c(\omega_q+\dot{\lambda}_q-\omega_u\lambda_r) + \lambda r[D\lambda_r + D_c(\omega_r+\dot{\lambda}_r+\omega_u\lambda_q)]\} \quad (27)$$

The function of sight 30 in FIG. 1 is merely to present an adjustable aiming reticle which is a visible spot representing angular displacements from the airframe axes. Except for wide angle coverage capability, the sight 30 has standard head-up display requirements. The aiming image is conveniently generated by cathode ray tube 31. The spot is projected by an ellipsoidal reflector 34 onto an ellipsoidal combining glass 36. In order to keep the sight assembly compact, folding mirrors 38 are provided. Corrector lens 35 compensates for aberations in the two ellipsoidal elements 34 and 36. Relay lens 32 is of a double-gauss type which is of smaller size than normal because of the use of field lens 33 to converge the spot image light.

One way of implementing the invention is with analog components as shown by the FIG. 6 block diagram. As in FIG. 1, the outputs $Q_w$ and $Q_v$ of two linear accelerometers 13 and 14 are used both to compute components of angle of attack $\alpha_v$, $\alpha_w$ in accordance with equations (7) and (8) in the equation solver 79 and to measure centrifugal acceleration $a_v$ and $a_w$ for computing turning rate $w_v$ and $w_w$. For the latter purpose, the same outputs $Q_v$ and $Q_w$ are corrected by subtracting the components of gravity $gZ_v$ and $gZ_w$ along the lift and lateral axes by differentials 90 and 91. It will be recognized that the turning rates required are those of the aircraft velocity vector rather than those of the airframe, and thus the accelerometers provided a better measure than do rate gyroscopes. The components of gravity used to correct the accelerations and to generate the bomb drop correction are obtained by resolving in resolver 61 a vertical vector into airframe axes by using roll and pitch angles from conventional vertical gyro 12.

The components of centrifugal acceleration are divided by divider 66 by aircraft speed $V_a$ to obtain turning rate $\omega$ which is then multiplied by scale factor S to obtain the components $\lambda_v$ and $\lambda_w$ of lead angle $\bar{\lambda}$ which will produce the curved path to the release point $P_R$. S is computed by equation solver 78 from present range $D_c$, speed $V_a$, and the desired release range $D_R$ in accordance with the preferred relation previously given in equation (1) which for S is $S = 2V_a D_c / D_C^2 - D_R^2$.

To obtain the gravity-drop correction in ballistic computer 62, the vertical fall G of the bomb corresponding to release range $D_R$ is obtained using conventional relations from range $D_R$, speed V, and the drag-mass characteristics of the bomb. G is then divided by present range $D_c$ to obtain a correction angle. This is small at the start of the bomb run and increases to the required value for bomb release when $D_c = D_R$. This angle, resolved into its components in aircraft axes is added to the lead angle $\bar{\lambda}$ and corrected by angles of attack $\alpha_v$ and $\alpha_w$ to obtain the total lead angle components $L_v$ and $L_w$ transmitted to the sight 80.

The continuous range $D_c$ is generated by updating and correcting the initial estimate $D_o$ manually inserted. The updating is done by integrating the aircraft velocity with respect to time, and the correction is done by comparing the angular rate of the line of sight with the value computed from the known speed and the lead angle between the line of sight and the aircraft velocity vector. The relation used is $$D_c = D_o - \int [V_a + K(V_a \lambda - D_c \dot{\Sigma})]dt.$$

The mechanization of the FIG. 6 bombing system is straightforward and more easily communicated to those other than specialists in the incremental/digital arts of computation. Conventional analog computer elements, even electromechanical types, can be employed. Conveniently, d-c operational amplifier and quarter-square multiplier circuits circuits serve for multiplication (64, 65, 67, 69, 70, 72) and division (66). Differentiation (68), integration (71), and the combined algebraic operations for equatiion solution (62, 78, 79) are handled by means of conventional operational amplifiers. Although standard weapon delivery sights can be employed, a wide angle capability is important for fully using the range correction capability by having relatively large lead angles and therefore correspondingly large turning rate signals in the contributions from noise, wind buffeting, pilot errors, etc., are relatively diminished. An economical approach is to modify a standard sight by mounting the combining glass with a pivoting linkage. In fact, FIG. 6 system, including the sight, can be implemented by modifications of the "Kinematic Sight", described in patent application Ser. No. 396,688, filed Sept. 15, 1964 by Gene Tye, in accordance with the above description to implement curved approaches and engineering changes well known to those skilled in the art to provide a controlled reticle, etc.

In following a particular desired tracking path, a continuous set of corresponding pairs of values exist for the lead angle $\lambda$ and the turning rate $\omega$, that is aircraft attitude and rate of change of attitude, neglecting the angle of attack $\omega$. (With the preferred circular path, $\omega$ is constant for perfect tracking.) There are two basic optional approaches to implementing the invention. The first approach is to vary the turning rate so as to produce the correct lead angle and the other approach is to vary the lead angle so as to produce the correct turning rate. Because $\lambda$ and $\omega$ are dependent variables, these approaches are actually equivalent but the former implies that the pilot manipulates aircraft control surfaces into relatively steady positions where the aircraft is banked and diving under an approximately constant condition that produces accelerometer (or rate gyro) signals in accordance with correct tracking. The instantaneous aiming reticle position is made a function of the measured turning rate and the desired turning rate for a proper tracking path.

For implementation of the invention in automatic or semi-automatic forms, it is necessary to introduce signals representing the traverse and elevation angles $\lambda_u$ and $\lambda_v$. Generally, this is performed by manual or automatic manipulation of a sighting element which thereby generates signals representing the lead angles in aircraft coordinates. In a manner corresponding to the embodiment described herein, these signals can be employed to control the flight path, with the roles of lead angle and turning rates interchanged.

Usually, it is desirable to deliver tactical stores at as close a range as possible, consistent with burst and terrain avoidance, so that the miss distances are minimized. In the preferred target approach, in a plane containing the aircraft velocity vector and the release point, the slope of the plane is normally small and the slope falls within a relatively small range of angles. This results in the time of flight for a bomb being relatively small, so that the gravity drop tends to be near constant, and for some applications, it can be treated as constant.

While particular embodiments of the invention have been shown and described herein, it is not intended that the invention be limited to such disclosure, but that changes and modifications can be made and incorporated within the scope of the claims.

What is claimed is:

1. A central system for directing maneuvers of an aircraft for precision delivery of bombs and similar stores, comprising:

a. a source of signals representing turning motion of an aircraft;

b. a source of signals representing the velocity of said aircraft;

c. a sight, displaying a variable position, visible aiming point image, adapted to effectively measure the direction of a target and to simultaneously direct aircraft maneuvers;

d. a sight computer, responsive to said turning motion signals and to said signals representing the velocity, for generating a signal to position said aiming point image to indicate proper orientation of said aircraft with said target to maintain said turning motion constant whereby tracking said target with said image will cause said aircraft to fly along a curved path in a slant plane to a bomb release point.

2. A bombing control system comprising:

a. an optical sight for presenting a moveable aiming reticle to a pilot for tracking a target;

b. a computer for generating a kinematic lead factor signal as a function of $(D^2 - D_R^2)/2\dot{D}D$, where D is the target distance, $D_R$ is the bomb release range, and $\dot{D}$ is the rate of change of the target distance;

c. a source of signals representing target range D, release range $D_R$, airspeed V, and present target lead angle $\lambda$;

d. said computer also containing means for providing an offset signal to compensate for the ballistic characteristics of bombs to be used with the system;

e. signal transmitting means for conveying said signals representing D, $D_R$, V and $\lambda$ from said source to said computer;

f. said computer being responsive to said signals representing D, $D_R$, V and $\lambda$ for computing said rate of change of the target distance $\dot{D}$ and for generating said kinematic lead factor signal;

g. means responsive to said computer for driving said reticle in accordance with said kinematic lead factor and offset signals.

3. An airborne aerial bombing control system for determining a curved bombing run approach path for an aircraft in an oblique plane and for locating in space the appropriate release point for a bomb to hit a target comprising:

a. airborne means for sensing, and generating environmental signals representative of, range $D_o$ from an initial point on said approach path to said target, range $D_R$ from said release point to said target, airspeed V of said aircraft, and rate of turn $\omega$ of said aircraft;

b. computer means responsive to said signals for 1. computing, and generating additional signals representative of, the corrected range $D_c$ from said aircraft to said target, and 2. computing from all said signals, alignment signals representing the proper angular divergence $\lambda$ between axes of said aircraft and the line of sight from said aircraft to said target on the basis of $$\lambda \propto \omega(D_c^2 - D_r^2)/2\dot{D}D_c$$

to maintain said approach path a curved path with an approximately constant curvature; and c. wide angle sight apparatus including a sighting reticle moveable within the field of vision of a pilot of said aircraft to indicate a direction from said aircraft and means for moving said reticle responsive to said alignment signals to permit said pilot by tracking said target with said reticle to cause said flight path to pass through an appropriate bomb release point.

4. A control system for directing the maneuver of an aircraft for precision delivery of bombs and similar stores comprising:

a. a source of signals dependent on and representing turning motion of said aircraft about more than one axis of said aircraft;

b. a source of signals representing the velocity of said aircraft;

c. a sight, displaying a variable position, visible aiming point image, adapted to effectively measure the direction of a target and to simultaneously direct aircraft maneuvers;

d. a sight computer, responsive to said turning motion signals and to said signals representing the velocity, for generating a signal to position said aiming point image to indicate proper orientation of said aircraft with said target to maintain said turning motion constant whereby tracking said target with said image will cause said aircraft to fly along a curved path in a slant plane to a bomb release point from which point a released bomb in free fall flight will hit said target.

* * * * *